US006298488B1

(12) United States Patent
Duncan et al.

(10) Patent No.: US 6,298,488 B1
(45) Date of Patent: Oct. 9, 2001

(54) MULTIPURPOSE IMPLEMENT FOR KITCHEN USE

(76) Inventors: David D. Duncan; Robin Lee Duncan, both of P.O. Box 802882, Castaic, CA (US) 91384

( * ) Notice: Subject to any disclaimer, the term of this patent is extended or adjusted under 35 U.S.C. 154(b) by 0 days.

(21) Appl. No.: 09/439,062

(22) Filed: Nov. 12, 1999

Related U.S. Application Data

(60) Provisional application No. 60/108,437, filed on Nov. 13, 1998.

(51) Int. Cl.[7] ..... A41D 25/00
(52) U.S. Cl. ..... 2/158; 2/16
(58) Field of Search ..... 2/16, 20, 158, 2/159, 160; D2/119; 15/227; 16/116 A

(56) References Cited

U.S. PATENT DOCUMENTS 2,810,131 * 10/1957 Kogut ..... 2/20
2,884,644 * 9/1959 Jefferson ..... 15/227
2,905,946 * 9/1959 Goldsmith ..... 2/20
4,523,348 * 6/1985 Petrie ..... 15/227
5,956,770 * 9/1999 Dennis ..... 2/160

* cited by examiner

*Primary Examiner*—John J. Calvert
*Assistant Examiner*—Katherine Moran
(74) *Attorney, Agent, or Firm*—Roger A. Marrs

(57) ABSTRACT

A kitchen grip or implement for kitchen use is composed of a water-resistant and stain proof material having temperature control characteristics. Such a material forms the implement from at least one sheet having a textured, recessed or irregular surface providing a non-slip contact surface while the opposite surface of the sheet is composed of a close fabricated fabric which is affixed to the sheet of non-slip contact surface material. The fabric sheet may be a sheet of nylon/polyester composition which is affixed to the non-slip contact surface sheet which may be composed of a chloride rubber. The sheets are die cut to the shape of a useful implement such as a hand mitt, a trivet, a lid holder or the like. A two-piece implement such as a hand mitt requires that two sheets of the fabric and chloride rubber composition be sewn together by means of a zigzag lock stitch employing nylon thread. One surface of the mitt may include a cross-cut textured recessed imprint providing a non-slip or gripping contact surface while the opposite exposed surface of the mitt may take the form of the smooth nylon/ polyester fabric.

5 Claims, 2 Drawing Sheets

FIG. 1
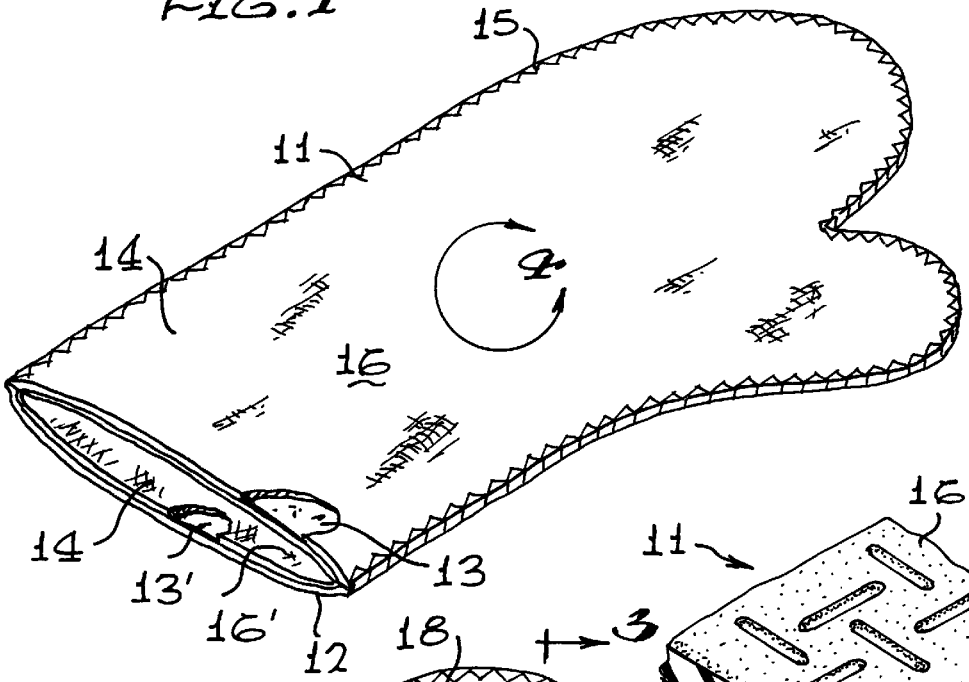
FIG. 2
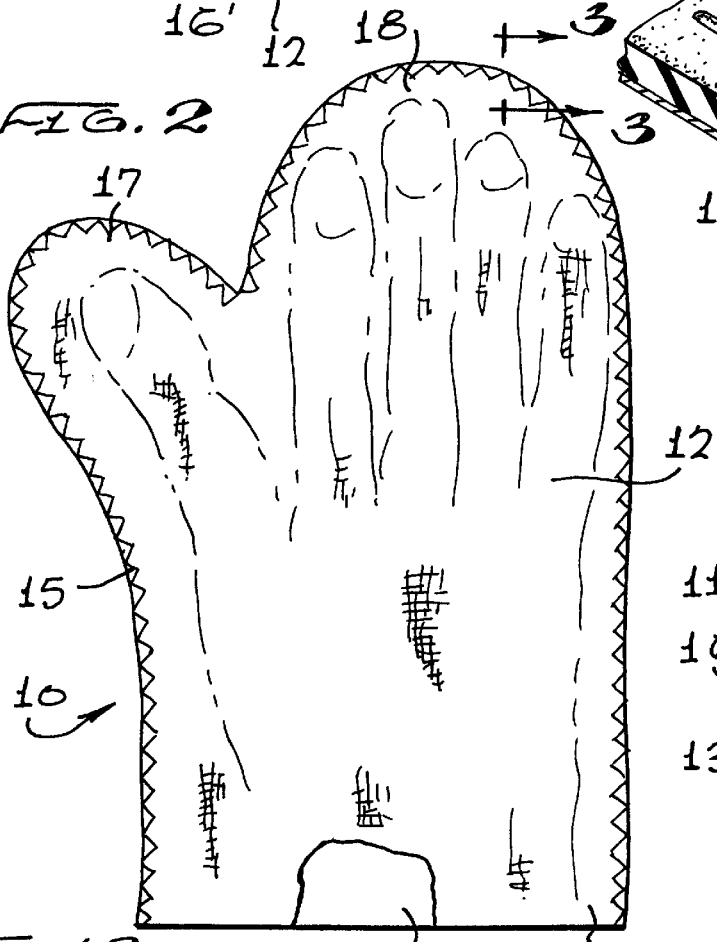
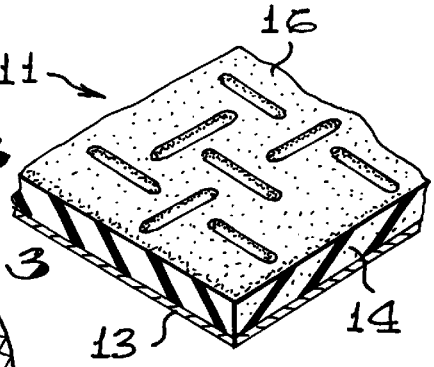
FIG. 4
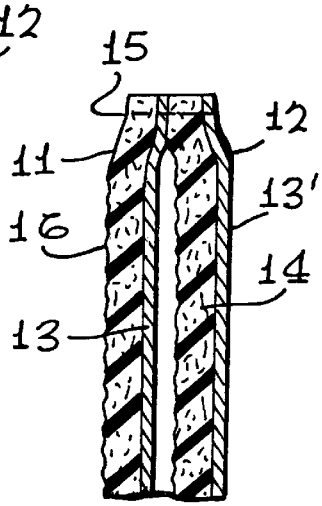
FIG. 3
FIG. 12
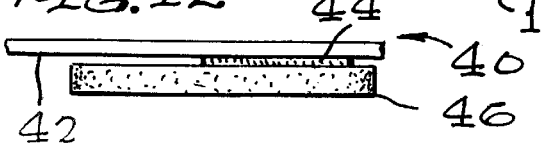

20
26
7
7
23
28
21
25

36
35
37
38

44
40
41
42
44
43

51
55
54
50
52
56
57
53

27
24
22
25

28
26
30
31
27

61
60
62
64
65

MULTIPURPOSE IMPLEMENT FOR KITCHEN USE

Priority based on Ser. No. 60-108,437 filed Nov. 13, 1998.

BACKGROUND OF THE INVENTION

1. Field of the Invention

The present invention relates to multipurpose kitchen implements for supporting, holding or gripping a variety of hot or cold articles such as cooking pots, pans, lids, handles or the like.

2. Brief Description of the Prior Art

In the past, it has been the conventional practice to employ cloth mitts and/or potholders for protecting the hands of the user from burning when handling hot articles in the kitchen such as cooking pots, pans or the like. Also, fabric or other porous materials are currently being used for supporting heated articles in order to protect a table or counter surface. Such conventional kitchen implements are disclosed in U.S. Pat. Nos. 2,261,064; 3,535,708; 4,071,921 and 580,148.

Problems and difficulties have been encountered when using such conventional kitchen implements which stem largely from the fact that the articles are composed of cloth and are not water-repellant, stain resistant and lack temperature control. The prior kitchen implements permit liquids to penetrate straight through to the hand or fingers of the user when used as a mitt or potholder. Such penetration serves as a conductor for hot substances and transmits the heat directly to the user's hands. Furthermore, the liquid or substance stains the material and now must be treated and laundered. During the treatment and laundering procedure, the soiled mitt or potholder is out of service requiring the user to have backup implements. Even after laundering, conventional mitts, potholders and trivets remain permanently stained.

Therefore, a long-standing need has existed to provide kitchen implements for protecting the hands and fingers of a cook or other person from injury due to excessive hot or cold temperatures and to provide such implements which are composed of water-repellant and stain resistant materials. Also, it is preferred that such implements are small and compact and are not bulky, unsightly or unsuitable for storage when not in use.

SUMMARY OF THE INVENTION

Accordingly, the above problems and difficulties are avoided by the present invention which provides a novel kitchen grip or implement for kitchen use which is composed of a water-resistant and stainproof material having temperature control characteristics. Such a material forms the implement from a sheet having a textured, recessed imprint on one surface providing a non-slip contact surface while the opposite surface of the sheet is composed of a close fabricated fabric which is affixed to the sheet of textured, non-slip contact surface material. The fabric sheet may be a sheet of nylon/polyester composition which is affixed to the non-slip contact surface sheet which may be composed of a chloride rubber. The sheets are then die cut to the shape of a useful implement such as a hand mitt, a trivet, a lid holder or the like. A two-piece implement such as a hand mitt requires that two pieces of the fabric and chloride rubber sheets be sewn together by means of a zigzag lock stitch employing nylon thread. Therefore, one surface of the mitt may include a cross-cut textured recessed imprint providing a non-slip or gripping contact surface while the opposite exposed surface of the mitt may take the form of the smooth nylon/polyester fabric. The gripping or chloride rubber neoprene sheet serves as a very efficient hot and cold temperature insulator for the user's hands and fingers and the surface of the chloride rubber neoprene sheet resists impregnation by stains and other damaging compositions and such surface is easily washed when rinsed under water. Also, it is noted that the sheet of nylon polyester fabric is water and stain resistant as well which characteristics are greatly augmented when attached or carried on the sheet of chloride rubber neoprene.

Therefore, it is among the primary objects of the present invention to provide a novel kitchen implement which may take the form of a potholder, trivet or mitt which has a composition characterized as being water-repellant, stain resistant and which includes temperature control characteristics for the protection of the user.

Another object of the present invention is to provide such kitchen implements which are intended to work with cast iron, aluminum, stainless steel or plastic micowave cookware and which is intended to be used with hot articles or articles subject to sub-zero or refrigerator freezer temperatures.

Still a further object of the present invention is to provide a multipurpose kitchen implement which is composed of a sheet of flexible material having a surface which is smooth composed of a layer of nylon/polyester fabric affixed to a layer of chloride rubber neoprene which may then be die cut to the shape of a desired implement resulting in a one or two-piece implement that is water-resistant and protects the hands and fingers of the user from hot and cold liquids or surface contacts.

Still a further object of the present invention is to provide a novel multipurpose kitchen implement that includes material which is water-repellant and stainproof and which further provides temperature control and protection for the user and which provides a positive gripping contact allowing the user to securely grasp either hot articles or frozen articles without fear of the article slipping from their hand.

A further object resides in providing a potholder, hot pad or other kitchen implement which includes a surface having a high coefficient of friction so as to provide a positive gripping action by a person holding a hot or cold item with the implement.

DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a perspective view showing a kitchen implement taking the form of a hand mitt incorporating the present invention;

FIG. 2 is a top plan view of the mitt shown in FIG. 1;

FIG. 3 is an enlarged cross-sectional view of the oven mitt shown in FIG. 2 as taken in the direction of arrows 3—3 thereof;

FIG. 4 is a greatly enlarged view of the non-slip or gripping surface exposed on one side of the mitt demonstrated in FIGS. 1 and 2;

FIG. 9 is a perspective view of still a further embodiment of the present invention showing the kitchen implement as a hand-held holder for detachably connecting with a scrub pad or the like;

FIG. 10 is a perspective view of still another embodiment of the invention illustrating a kitchen implement as a holder or gripping member for grasping handles on a pot lid or the like;

FIG. 12 is a reduced side elevational view, partly in section, showing the holder illustrated in FIG. 10 attached to a scrub pad or the like.

DESCRIPTION OF THE PREFERRED EMBODIMENTS

Figure 5:
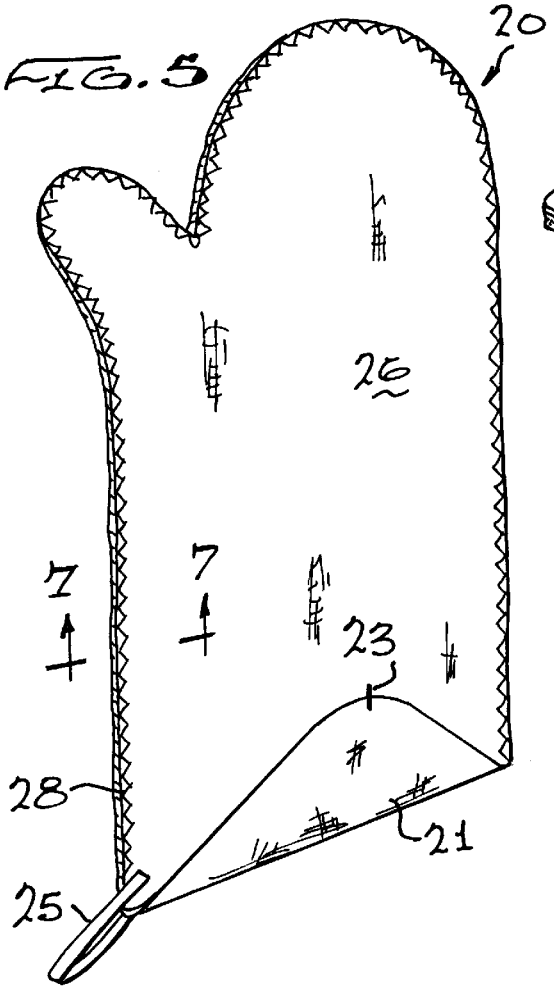
FIG. 5 is a top elevational view of another version of the present invention illustrating a flat opening leading into the interior of a mitt incorporating the present invention.

Referring to FIG. 1, an example of a novel kitchen implement or aid is illustrated in the general direction of arrow 10 which takes the form of a mitt intended to be worn when handling extremely hot or cold articles. The mitt 10 includes a top sheet 11 and an under or opposite sheet 12 wherein the sheet 11 includes an irregular surface and is intended to correspond with the palm of the user when the mitt is on the right hand. The top and bottom sheets 11 and 12 are each composed of a sheet or layer of nylon/polyester fabric 13 and 13' and a layer of a chloride rubber "neoprene" composition identified by numerals 14 and 14'. The layers are suitable affixed to one another to provide each of the respective sheets in accordance with conventional practice. When the sheets are die cut to a particular shape such as that of a hand mitt, the two die-cut sections comprising a top and bottom section have their peripheral edges attached together such as by a zigzag stitch representing a lock stitch as shown by numeral 15. The zigzag sewing compresses the peripheral edge marginal regions of the respective sheets so as to create a water-resistant seam to protect the hands of the wearer from hot and cold liquids.

Of most importance is the fact that each of the respective sheets 11 and 12 are provided with an irregular surface such as the waffle surface indicated by numeral 16. In FIG. 1, the irregular surface 16 is on the exterior of the mitt so that the user can grasp a utensil with the irregular surface. However, the mitt illustrates the irregular surface in connection with sheet 12 as being on the inside of the mitt. Therefore, the user has the option of gripping a kitchen utensil by using the irregular surface 16 or by reversing the mitt on his or her hand so that the palm of the hand bears against the interior irregular surface of the sheet 12. In this way, greater utility of usage is provided when only one exterior surface is irregular while the opposite surface is smooth.

Referring now to FIG. 2, the mitt 10 has been flipped over from the position shown in FIG. 1 so that layer 12 is on top. Layer 12 is partially broken away to illustrate that the interior of the mitt includes a smooth surface 13 on the fabric layer of sheet 11. Therefore, it is again emphasized that an irregular or gripping surface is provided on the inside of the glove when used in one way and the irregular or gripping surface is on the exterior of the glove or mitt when used for another purpose. It can be seen that the die-cut sheets of material include an outwardly projecting portion 17 for insertably receiving the thumb of the user while a rounded frontal portion 18 of the mitt is employed for insertably receiving the fingers of the user.

Referring now in detail to FIG. 3, it can be seen that surface 16 is irregular on sheet 11 and that the irregular surface is exterior. The exterior surface on sheet 13' is smooth with respect to sheet 12. The surface 16' carried on layer 14' is irregular and waffled so that the hand of the user is immediately adjacent to the irregular surface when it is desired to grasp an article with the smooth surface 13'.

Referring now in detail to FIG. 4, it can be seen that the irregular surface 16 of layer 14 carried on layer 13 of sheet 11 is irregular and may take any suitable irregular configuration such as the presence of ribs, recesses, depressions, crosshatching or the like.

Figure 6:
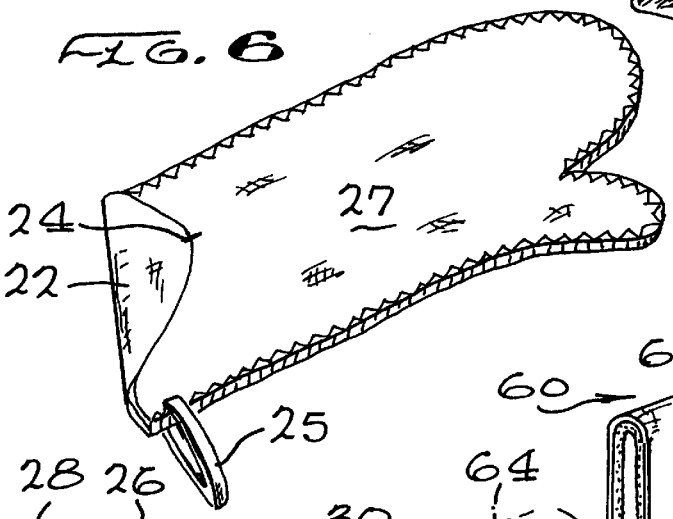
FIG. 6 is a reverse view of the mitt shown in FIG. 5.

Referring now in detail to FIG. 5, another embodiment of the present invention is illustrated in the general direction of arrow 10 wherein the mitt has been modified at its entrance into the interior by providing a pair of flaps such as flap 21 in FIG. 5 and flap 22 in FIG. 6. By providing the flaps and by affixing the corner of the flap to the respective sheet, the flaps remain folded so as to provide an easy entrance or access into the interior of the mitt. The affixing of the flap may be done by a suitable stitch 23 or 24 and the mitt may be further modified by providing a loop 25 suitable for hanging the mitt on a hook or other support when not in use. Also, it is to be noted that mitt 20 in FIGS. 5 and 6 provides external surfaces on both sides with the irregular waffling and the irregular surfaces are represented by numeral 26 on. one side and numeral 27 on the opposite side. Lock stitching 28 is identical to the compression stitch shown in previous FIGURES and represented by numeral 15.

Figure 7:
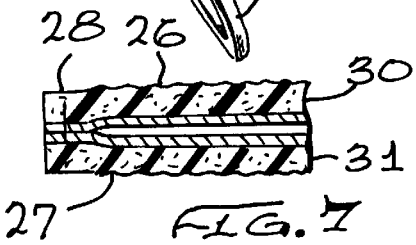
FIG. 7 is a fragmentary cross-sectional view of the mitt shown in FIG. 5 taken in the direction of arrows 7—7 thereof.

FIG. 7 illustrates the exterior exposure for the surfaces 26 and 27 respectively and that the interior surfaces are arranged in opposing relationship with respect to one another and that these surfaces are smooth. A gap exists between the respective sheets, identified by numerals 30 and 31, so that the user may readily insert his hand between the flaps 21 and 22 into the interior of a mitt.

Figure 8:
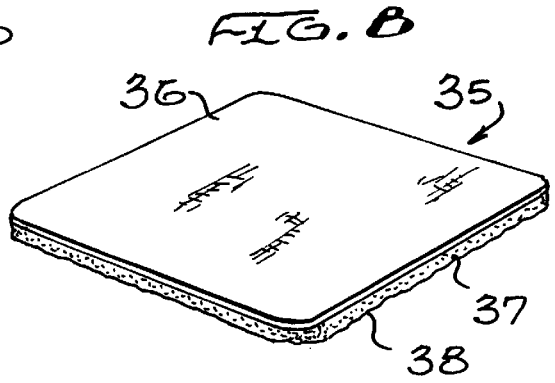
FIG. 8 is a perspective view of another version of the invention illustrating the use of the inventive kitchen implement as a trivet or tabletop protector.

Referring now in detail to FIG. 8, another embodiment of the invention is illustrated wherein a single sheet is employed as a trivet or hot or cold pad and is illustrated in the general direction of arrow 35. The single sheet includes a nylon/polyester fabric 36 and the chloride rubber sheet 37. The underside of the article is indicated by numeral 38 and is of an irregular surface so as to provide a suitable grip against any surface on which it is placed. The irregularity of the surface may take the form of waffling, ribs, depressions or the like.

Figure 9:
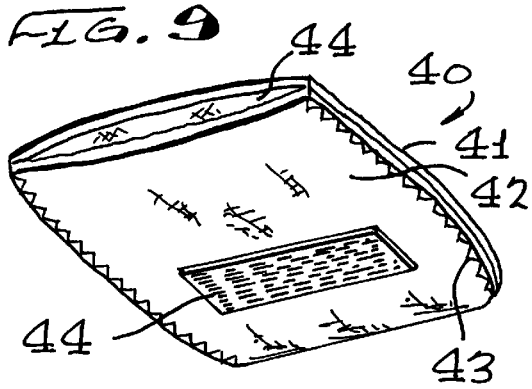

Referring now to FIG. 9, another embodiment is illustrated in which a pouch is indicated in the direction of arrow 40 which includes a pair of sheets 41 and 42 wherein the sheets are as of previously described compositions and having edge marginal regions joined by a lock stitch 43. A cavity is provided between the opposing surfaces of the sheets, as indicated by numeral 44, into which the user's hand may be inserted. A feature of the pouch 40 resides in placing an attachment component 44 on the exterior surface of the sheet 42 which may be of a hook and pile fastener type. Preferably, the attachment means 44 is of a hook component so that it may be readily detachably connected to a scrubbing article such as a scrub pad or the like. Such an article is illustrated in FIG. 12 by numeral 46 with the pad 40 and sheet 42. The attachment component 44 will readily connect or disconnect the scrub pad 46 with the finger pouch 40.

Figure 10:
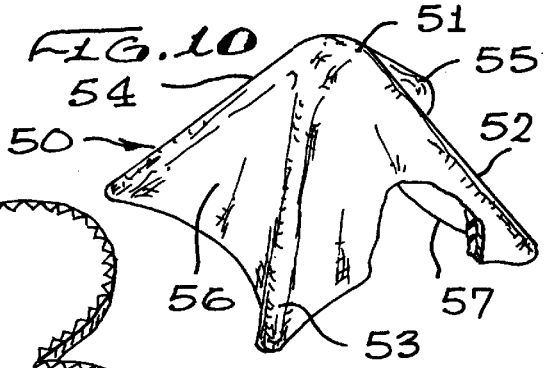

Referring now to FIG. 10, still another embodiment of the invention is illustrated in the general direction of arrow 50 taking the form of a hand-held sheet which is prefolded to present an apex 51 with ribs 52, 53, 54 and 55 between which are situated depressions such as depression 56. The user grasps the respective depressions between the ribs with the fingers of one hand and the interior of the cup-like sheet 50 is used to be placed over a lid handle or pot handle. It is to be particularly noted that the external surface of the sheet is smooth while the internal or cavity side surface of the sheet, as represented by numeral 57, is roughened or of an irregular configuration as previously described with respect to other embodiments.

Figure 11:
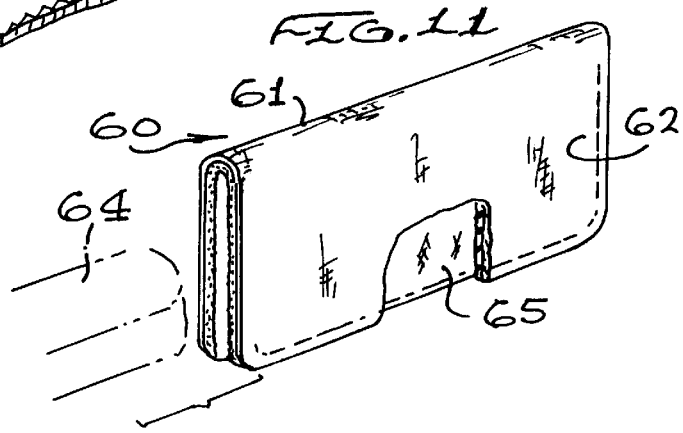
FIG. 11 is still a further embodiment of another version of the present invention illustrating a kitchen implement as a sleeve intended to insertably receive the handle of a pan.

Referring now to FIG. 11, still another embodiment is illustrated in the general direction of arrow 60 which forms a sleeve by taking a sheet of the double layered material and folding the sheet over to provide a single fold 61 so that the peripheral edges when placed together may be sewn together by a suitable lock stitch 62. However, the end of the sleeve is maintained open to provide for insertion of a pot handle or the like into the interior 63 of the sleeve. The potholder is indicated by numeral 64 and a side of the sleeve is broken away to show that the interior of the sleeve is of an irregular surface 65. Therefore, once the handle 64 is inside the sleeve, the user may grip the exterior surface of the sleeve so that the irregular gripping surface of the interior may come into contact with the handle 64.

In view of the foregoing, it can be seen that the multi-purpose implement for kitchen use incorporating the present invention provides a water-resistant, stain resistant and temperature controlling non-slip interior or exterior surface grip for handling hot or cold articles. The gripping surface is provided by a chloride rubber neoprene material and also provides a cushion for comfortably and conveniently handling pots, cooking utensils or the like. A sheet of nylon/polyester fabric is affixed to a sheet of chloride rubber b[], any suitable means and is then die cut to the shape of a particular implement such as a hand mitt. The two pieces or sheets consisting of a top die-cut section and a bottom die-cut section have their peripheral edges attached either by means of sonic welding or by means of a zigzag lock stitch and with nylon thread. The zigzag stitching compression of the material creates a water-resistant seam to protect the hands of the wearer from liquids. The chloride rubber surface providing a non-slip grip is manufactured with a cross-cut textured recessed imprint providing the non-slip contact surface. The chloride rubber neoprene acts as an efficient hot and cold temperature insulator for protection of the user's hands and the chloride rubber surface resists becoming impregnated with stains and washes clean when rinsed under water.

By using the present invention, the kitchen article or implement provides water-repellant characteristics so that water, liquids or moisture cannot interfere with the grip action. Even if the sheets or layers become wet, the product may be used without waiting to dry since the material repels water, liquids and moisture. Also, the inventive implements can be used in both hot and cold temperatures and can be used with kitchen cookware composed of cast iron, aluminum, stainless steel or plastic microwaveable cookware. It can be employed with all kitchen appliances including stove tops, ovens, microwaves, dishwashers, refrigerators and even sub-zero or refrigerator freezers. The inventive implements employ unique fabric which is designed to repel liquids rather than absorb them as with all other cloth mitts and potholders. If fluids or sauces come into contact with the inventive implements, the implements may be rinsed under water with no waiting to dry and are available for immediate usage.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A kitchen implement comprising:

a pair of sheets having identical configurations and residing next to each other so as to provide common edge marginal regions about a common and coextensive periphery;

said sheets having a central cavity with an entrance for insertably accepting the hand of a user between said sheets;

said sheets having opposing surfaces with at least one of said surfaces being of a irregular, frictional gripping surface;

said sheets being characterized as heat and cold temperature resistant and stain resistant;

stitching about said edge marginal region with a termination of said stitching defining said entrance;

said sheets each include a layer of compressible material and cooperates with said stitching upon compressing to provide a water resistant lock stitch securing said edge marginal regions together;

each of said sheets including a nylon/polyester fabric layer affixed to a chloride rubber neoprene layer;

said chloride rubber neoprene layer being compressible and in cooperation with said stitching provides a water resistant seam; and said stitching being a zig-zag stitch.

2. The kitchen implement defined in claim 1 wherein:

each of said sheets further includes an integral folded-back flap normally biasing said entrance to an open condition; and securement means for affixing said flaps to said sheets.

3. The kitchen implement defined in claim 1 including:

said attachment means about said common edge marginal region selected from a group consisting of sonic welding, stitching or adhesive.

4. A kitchen implement comprising:

a pair of sheets having identical configurations and residing next to each other so as to provide common edge marginal regions about a common and coextensive periphery;

said sheets having a central cavity with an entrance for insertably accepting the hand of a user between said sheets;

said sheets having opposing surfaces with at least one of said surfaces being of an irregular, frictional gripping surface;

said sheets being characterized as heat and cold temperature resistant and stain resistant;

stitching about said edge marginal region with a termination of said stitching defining said entrance;

said sheets each include a layer of compressible material and cooperates with said stitching upon compressing to provide a water resistant lock stitch securing said edge marginal regions together;

each of said sheets further includes an integral folded-back flap normally biasing said entrance to an open condition; and securement means for affixing said flaps to said sheets.

5. The kitchen implement defined in claim 4 including:

a loop attached to said sheets adjacent to said flaps for removably supporting said sheets from a support member.

* * * * *